US010627190B2

(12) United States Patent
Ryckman

(10) Patent No.: US 10,627,190 B2
(45) Date of Patent: Apr. 21, 2020

(54) GUN HOLSTER WITH MODULAR CONFIGURATIONAL FEATURES

(71) Applicant: Ryan S. Ryckman, Norfolk, VA (US)

(72) Inventor: Ryan S. Ryckman, Norfolk, VA (US)

( * ) Notice: Subject to any disclaimer, the term of this patent is extended or adjusted under 35 U.S.C. 154(b) by 0 days.

(21) Appl. No.: 16/250,546

(22) Filed: Jan. 17, 2019

(65) Prior Publication Data

US 2019/0219357 A1 Jul. 18, 2019

Related U.S. Application Data

(60) Provisional application No. 62/618,887, filed on Jan. 18, 2018.

(51) Int. Cl.

| | |
|---|---|
| ***F41C 33/02*** | (2006.01) |
| ***F41C 33/00*** | (2006.01) |
| ***F41C 33/04*** | (2006.01) |
| ***A45F 5/02*** | (2006.01) |

(52) U.S. Cl.

CPC ..... *F41C 33/041* (2013.01); *A45F 5/021* (2013.01); *F41C 33/0209* (2013.01); *F41C 33/0272* (2013.01); *A45F 2200/0591* (2013.01); *F41C 33/04* (2013.01); *F41C 33/048* (2013.01)

(58) Field of Classification Search

CPC ..... F41C 33/02; F41C 33/0209; F41C 33/04; F41C 33/041; F41C 33/048; A45F 2200/0591

USPC ..... 224/192, 193, 198, 238, 243, 244, 245, 224/911

See application file for complete search history.

(56) References Cited

U.S. PATENT DOCUMENTS 3,797,715 A * 3/1974 Scialdone ..... A45F 3/14 224/587
4,022,361 A * 5/1977 Devlin ..... A45F 5/021 224/192
4,258,871 A * 3/1981 McMahon ..... F41C 33/046 224/192
4,408,706 A * 10/1983 Hurley ..... B26B 29/025 224/192
4,848,624 A * 7/1989 Clem ..... A45C 1/04 224/222
5,170,919 A * 12/1992 DeSantis ..... A45C 1/04 224/192
5,236,113 A * 8/1993 Wisser ..... F41C 33/0227 224/193
5,240,156 A * 8/1993 Sicotte ..... A41F 9/002 224/148.5
5,294,031 A * 3/1994 Volpei ..... A45F 3/00 224/192

(Continued)

*Primary Examiner* — Justin M Larson
(74) *Attorney, Agent, or Firm* — William G. Sykes

(57) ABSTRACT

A holster to selectively vary accommodation of different guns, different holster wearing conditions, and different holster mountings is shown and described The holster includes a sheath for receiving a gun, the sheath including a retentive surface covering at least part of the sheath At least one detachable functional enhancement module is manually attachable to and removable from the sheath Modules may influence sheath configuration, gun position when inserted, gun withdrawal from the sheath, and mounting possibilities relative to environmental objects The sheath may comprise a flexible neoprene fabric coated with polyparaphenylene terephthalamide, with a hook and loop covering Modules may have corresponding hook and loop patches.

14 Claims, 4 Drawing Sheets

(56) References Cited

U.S. PATENT DOCUMENTS 5,632,426 A * 5/1997 Beletsky ..... A45F 5/021 224/192
5,909,834 A * 6/1999 Parrott, III ..... F41C 33/0209 224/245
5,991,925 A * 11/1999 Wu ..... A41D 13/0012 2/102
6,131,198 A * 10/2000 Westrick ..... F41C 33/0209 2/102
6,264,079 B1 * 7/2001 Skaggs ..... F41C 33/0236 224/193
6,296,164 B1 * 10/2001 Russo ..... A61F 5/449 224/581
6,367,672 B1 * 4/2002 Lind ..... A45F 5/02 224/245
6,685,066 B2 * 2/2004 Cragg ..... A45F 5/021 224/192
6,843,399 B2 * 1/2005 Garcia ..... F42B 39/02 224/665
8,307,465 B2 * 11/2012 French ..... A41D 27/20 2/250
8,479,331 B2 * 7/2013 Craighead ..... F41C 33/041 5/503.1
9,222,750 B1 * 12/2015 Keepers ..... F41C 33/0209
9,581,413 B2 * 2/2017 Massaro, Jr. ..... F41C 33/04
9,593,915 B2 * 3/2017 Tuggle ..... A45F 3/14
9,598,021 B2 * 3/2017 Noonan ..... F41C 33/041
9,772,162 B2 * 9/2017 Manglos ..... F42B 39/02
9,810,510 B2 * 11/2017 Massaro, Jr. ..... F41C 33/04
RE47,305 E * 3/2019 Keepers ..... F41C 33/0209
2004/0035900 A1 * 2/2004 Cragg ..... A45F 5/021 224/661
2005/0198872 A1 * 9/2005 Correa ..... A43B 3/0031 36/136
2011/0147428 A1 * 6/2011 Crawford ..... A45C 11/24 224/584
2015/0362284 A1 * 12/2015 Mileshko ..... F41C 33/0227 224/243
2019/0219357 A1 * 7/2019 Ryckman ..... F41C 33/0209

* cited by examiner

GUN HOLSTER WITH MODULAR CONFIGURATIONAL FEATURES

RELATED APPLICATIONS

This application claims priority in accordance with 37 CF.R. ¶ 1.19(e) to U.S. Provisional Patent Application Ser. No. 62/618,887 filed for GUN HOLSTER WITH MODULAR CONFIGURATIONAL FEATURES filed Jan. 1, 2018 which is included herein in its entirety by reference.

FIELD OF THE INVENTION

The present invention relates to holsters for accommodating diverse hand guns, and more particularly to modular configurational adjustment features therefor.

BACKGROUND OF THE INVENTION

When carried on the user's body, hand guns typically are carried within holsters in a pocket, attached to a belt of trousers, or attached to a waistband of trousers. Many different holsters have been provided to accommodate wearing positions and the many configurations of the hand guns themselves. However, a gun owner may own a plurality of guns. In such a case, the gun owner may need a different holster for each gun. And even where one holster is designed to work with one particular gun, there may be a need for diverse holsters for any one gun, depending upon each wearing position the user may desire. This can lead to requirement for an unnecessarily large number of holsters, which may come to significantly outnumber the guns themselves. This is objectionable due to storage considerations, convenience of locating one particular desired holster for each occasion, and total cost.

There exists a need for a holster to be adjustable for the various conditions of gun ownership and carrying situations.

SUMMARY OF THE INVENTION

The present invention contemplates a holster to selectively vary accommodation of different guns, different holster wearing conditions, and different holster mountings. The holster includes a sheath for receiving a gun, the sheath including a retentive surface covering at least part of the sheath. At least one detachable functional enhancement module is manually attachable to and removable from the sheath. A plurality of differently purposed modules are contemplated. Modules may influence sheath configuration gun position when inserted, gun withdrawal from the sheath, and mounting possibilities relative to environmental objects. The sheath may be flexible. Flatness of the sheath and internal configuration determine gun positioning within the sheath may be varied to suit by selection of an appropriate module. Mounting possibilities include accommodation of pocket receipt of the holster, support on a pants belt or partially on pants fabric, and docking on an environmental surface such as furniture.

The sheath may comprise a flexible neoprene fabric coated with polyparaphenylene terephthalamide, with a hook and loop covering. Modules may have corresponding hook and loop patches for ready installation on and removal from the sheath.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
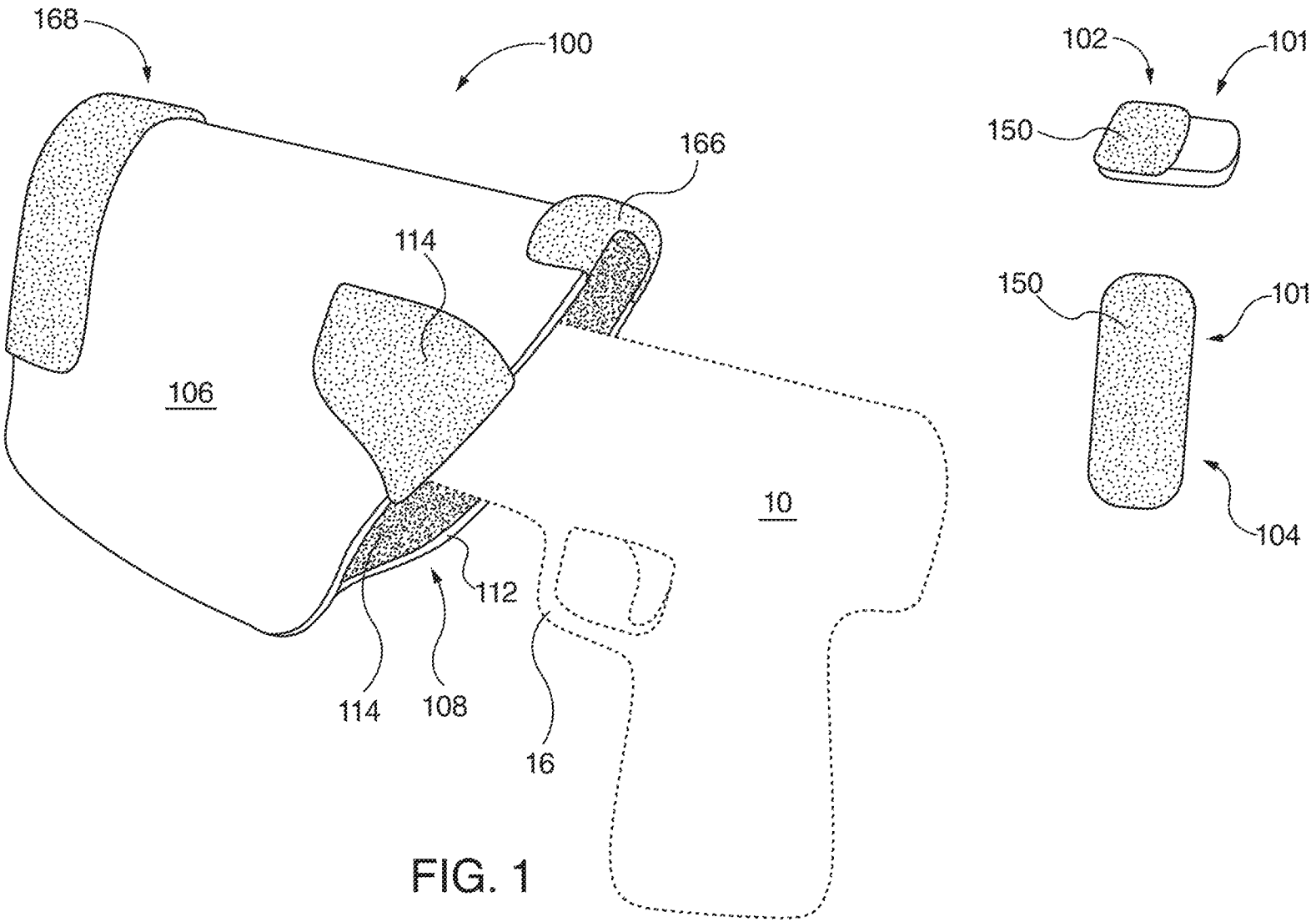
FIG. 1 is diagrammatic environmental side perspective view of a holster, according to at least one aspect of the invention.

Referring first to FIG. 1, according to at least one aspect of the invention, there is shown a holster 100 providing at least one detachable functional enhancement module 102, 104, to selectively vary accommodation of different guns (e.g., gun 10), different holster wearing conditions, and different holster mountings. Holster 100 comprises a sheath 106 including a mouth 108 for insertion of gun 10 and an opposed distal end 110. Sheath 106 comprises a structural substrate 112 and a retentive surface 114 covering at least part of structural substrate 112. Holster 100 also comprises at least one detachable functional enhancement module 102, 104 including a respective retention surface 116 removably attachable by contact with retentive surface. 114 of sheath 106. In the illustrated example of FIG. 1, retention surfaces. 114, 116 are complementing patches of hook and loop fastener mutually attachable by contact and manually separable from one another.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

A plurality of functional enhancement modules 101 may be provided, to satisfy a number of needs in readily installed and detached fashion. The at least one functional enhancement module 101 may comprise at least one of a first functional enhancement module 101 comprising a stop 102 inside sheath 106 when installed, stop 102 locatable and configured to limit penetration of gun 10 into sheath 106, and a second functional enhancement module 101 comprising a tensioning tab 105 inside sheath 106 when installed. The tensioning tab is locatable and configured to constrict sheath 106 to a width 118 (see FIG. 2) less than that which sheath 106 would assume in the absence of the constriction tab, to snug sheath 106 against gun 10.

Figure 4:
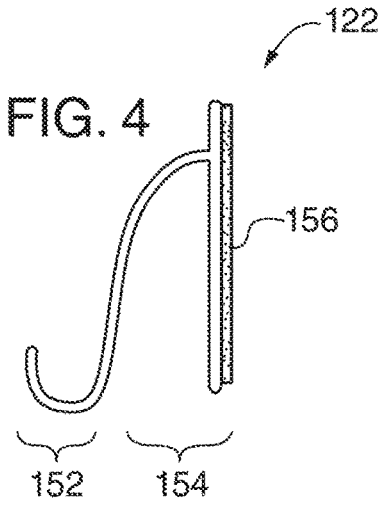
FIG. 4 is an enlarged detail end view of a component seen at the center of FIG. 3, according to yet another aspect of the invention.

A third functional enhancement module 101 (see FIGS. 3 and 4) may comprise comprising a belt clip 122 including a retention surface 124 removably attachable by contact with retentive surface 114 of sheath 106. In this example, retentive surface 114 comprises an external patch of hook and loop material. An additional portion of retentive surface 114 is internal to sheath 106, as seen in FIGS. 1 and 2.

Belt clip 122 engages a belt 18 typically used in trousers or pants 20. Belt clip 122 may comprise a feature configured to oppose tendency of fabric of pants 20 to separate belt clip 122 from gun 10 as gun 10 is being withdrawn from holster 100 when holster 100 is contained within a pocket 22 of pants 20. Belt clip 122 may comprise a first hook 152 (see FIG. 4) for engaging belt 18 installed on pants 20 and a second hook 152 encircling an exposed edge of pants 20. First hook 152 and second hook 154 open in opposed directions. Belt clip 122 may include a patch 156 of hook and loop material matingly compatible with retentive surface 114 of holster 100, so that the latter can be readily manually coupled to and removed from belt 18.

Figure 5:
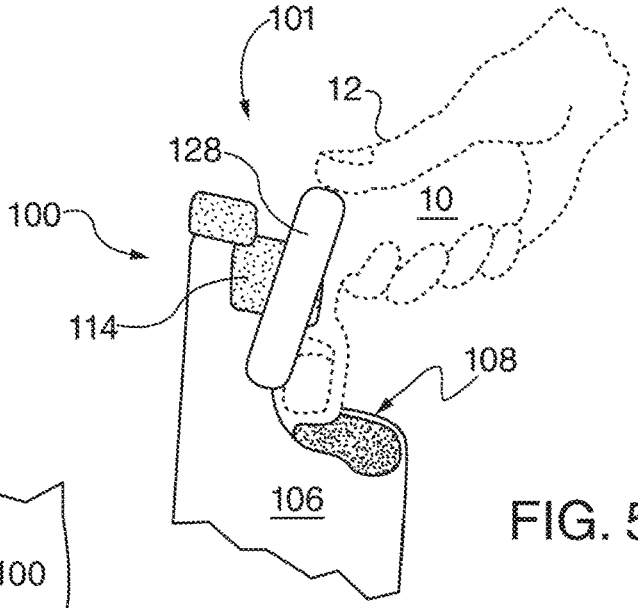
FIG. 5 is an environmental side view of a gun being withdrawn from a holster, according to still another aspect of the invention.

Referring to FIG. 5 a fourth functional enhancement module 101 comprises a pressure pad 128 removably locatable at mouth 108 of sheath 106 and configured to receive a thumb 12 or finger of the user and to transmit a pushing force from thumb 12 or finger against sheath 106, thereby facilitating withdrawal of gun 10 from sheath 106 when the user grasps gun 10 and presses on pressure pad 128 with thumb 12 or finger. Pressure pad 128 may comprise a rigid substrate and hook and loop liner for example.

Figure 2:
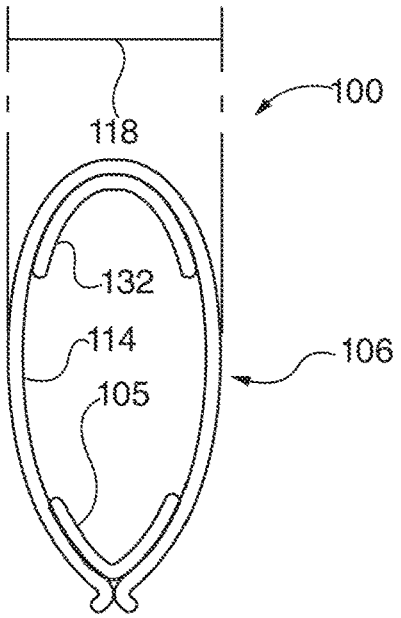
FIG. 2 is an end view of a holster, according to at least another aspect of the invention.
Figure 6:
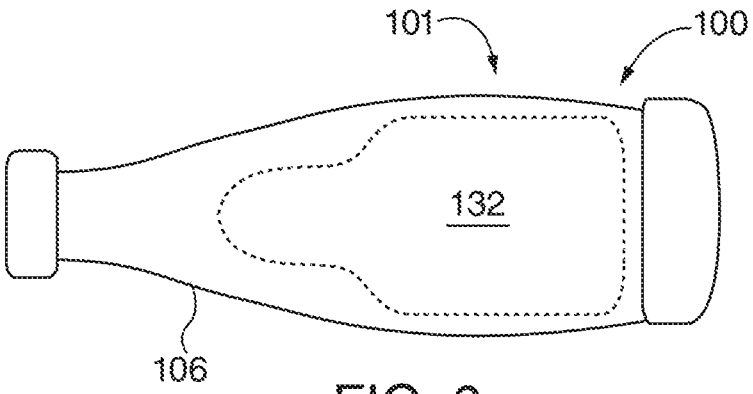
FIG. 6 is a top plan view of a holster, according to a further aspect of the invention.
Figure 7:
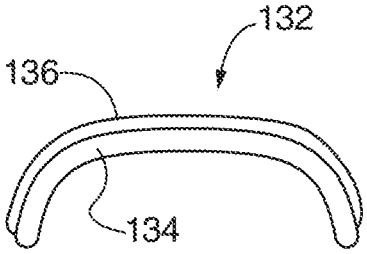
FIG. 7 is an end view of a component shown concealed in FIG. 6, according to yet another aspect of the invention.

As shown in FIGS. 2, 6, and 7, a fifth functional enhancement module 101 comprises a mouth spreader tab 132 inside sheath 106 when installed. Mouth spreader tab 132 is locatable and configured to oppose spontaneous narrowing of sheath 106 after gun 10 is withdrawn therefrom, to facilitate subsequent reinsertion of gun 10 past mouth 108 and into sheath 106. Particularly referring to FIG. 7, mouth spreader tab 132 of fifth functional enhancement module 101 may comprise a first ply including hook and loop material 136 and a stiffener structure 134 configured to increase stiffness of the first ply. Stiffener structure 134 may comprise a plastic panel parallel to and abutting the first ply.

As employed herein, "matingly compatible", where applied to hook and loop fastening material, signifies a polarity (hook or loop) opposite that patch of hook and loop material to which it is to be fastened.

Figure 8:
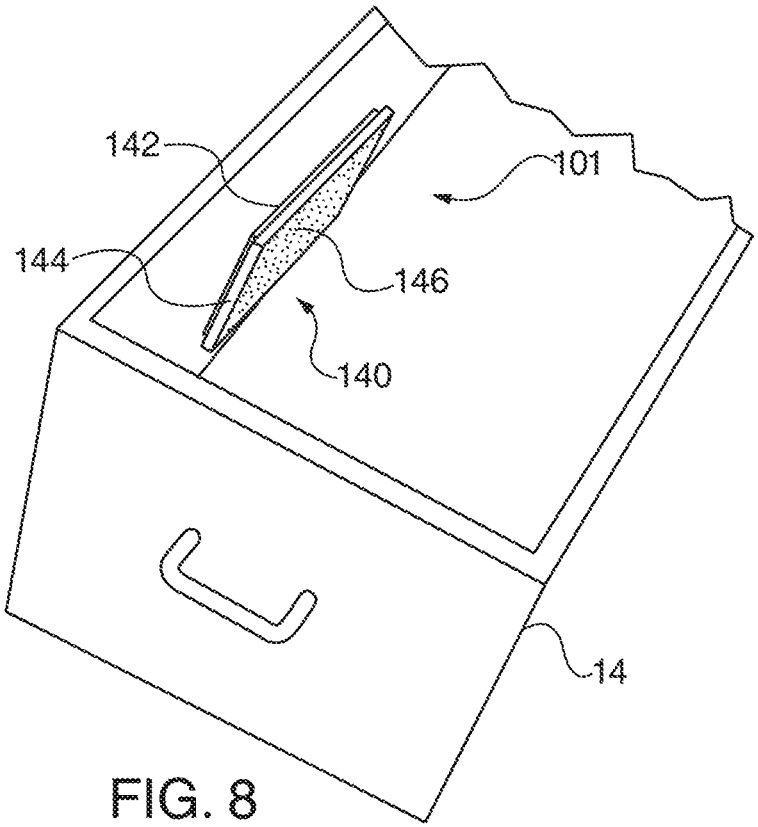
FIG. 8 is a perspective environmental view of a docking station usable with the novel holster, according to still another aspect of the invention.

As seen in FIG. 8, a sixth functional enhancement module 101 comprises a docking station 140 including a mounting side bearing an adhesive 142 and an opposed holster retaining side 144 comprising a retention surface 146 removably attachable by contact with retentive surface 114 of sheath 106 of holster 100. Docking station 140 provides an interface enabling support of holster 100 on an environmental surface such as for example an interior surface of a drawer 14 of a desk (not shown in its entirety). Docking station 140 may have a length at least half of the length of sheath 106, and a height at least half of the height of sheath 106. These dimensional relationships assure that docking station 140 be readily attachable to its associated environmental surface, while still accommodating angular and positional adjustability of holster 100 when mounted to docking station 140.

Figure 3:
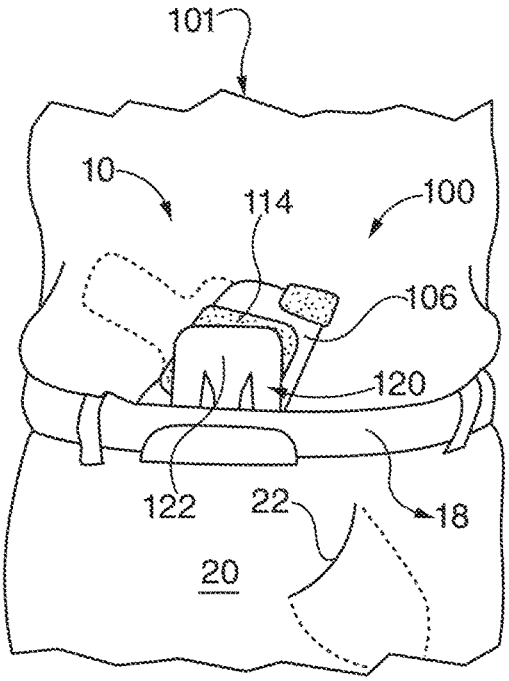
FIG. 3 is an environmental side view of a holster worn by a user, according to still another aspect the invention.
Figure 9:
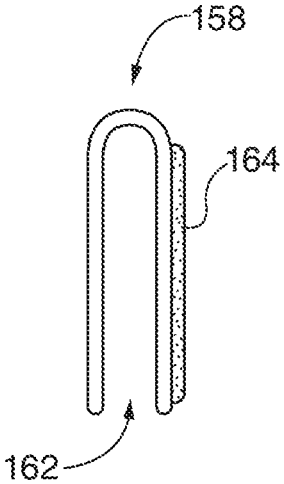
FIG. 9 is an end detail view of an optional docking station for environmental mounting and storage of a holster on a belt of pants or trousers of a user, according to a further aspect of the invention.

Whereas docking station 140 is adapted to engage a flat environmental surface, a modified docking station 158 may be adapted to engage a belt. As seen in FIG. 9, docking station 158 may include a belt engagement element enabling docking station 158 to be supported from belt 18 of the wearer on the outside of belt 18 (FIG. 3). The belt engagement element may comprise an inverted hook 162. Inverted hook 162 may include a patch 164 of hook and loop material matingly compatible with retentive surface 114 of holster 100.

It should be noted at this point that orientational terms such as inverted and front refer to the subject drawing as viewed by an observer. The drawing figures depict their subject matter in orientations of normal use, which could obviously change with changes in posture and position of the novel accessory mount as mounted on the personal watercraft. Therefore, orientational terms must be understood to provide semantic basis for purposes of description, and do not limit the invention or its component parts in any particular way.

Stop 102 may be located to interfere with a trigger guard 16 of gun 10, although any suitable portion of gun 10 may be engaged to render stop 102 operative. Trigger guard 16 serves well in this regard because it is close to the longitudinal center line of gun 10, and would not cause gun 10 to cock within holster 100 when gun 10 encounters stop 102. As seen in FIG. 1, stop 102 may comprise a pad 148 of a material which will not deflect or yield as gun 10 is inserted into holster 100, and a patch of hook and loop material matingly compatible with retention surface 114.

It is contemplated that holster 100 may be fabricated from a pliable or flexible material. This characteristic imparts practicality with diverse holster wearing styles, including concealed within a pocket 22 of pants 20 (see FIG. 3). To this end, in holster 100, structural substrate 112 (FIG. 1) of sheath 106 may comprise a flexible neoprene fabric coated with polyparaphenylene terephthalamide. Retentive surface 114 of sheath 106 may comprise hook and loop manual fastener of one polarity. Each functional enhancement module 101 may comprise a respective contact patch for engaging retentive surface 114 of sheath 106. Each respective contact patch may comprise hook and loop manual fastener of a polarity other than that of retentive surface 114 of sheath 106.

In holster 100, structural substrate 112 of sheath 106 may include an inner surface facing gun 10 when gun 10 is inside holster 100, and an opposed outer surface visible to view. Retentive surface 114 of sheath 106 may cover at least most of the inner surface of structural substrate 112, as may be gleaned from FIG. 1.

As also seen in FIG. 1, retentive surface 114 of sheath 106 may extend to at least part of the outer surface of sheath 106. For example, retentive surface 114 of sheath 106 may comprise hook or loop fastening material 166 covering an exposed edge of mouth 108 of sheath 106, to oppose snagging of gun 10 when gun 10 is reinserted into holster 100. Similarly, an extended portion 168 of retentive surface 114 of sheath 108 may cover a forward edge of holster 100, thereby opposing snagging of holster 100 on is reinserted into holster 100. Similarly, an extended portion 16.8 of retentive surface 114 of sheath 108 may cover a forward edge of bolster 100, thereby opposing snagging of holster 100 on pocket 22 when holster 100 is being inserted into pocket 22. Portion 168 may be sufficiently yielding as to facilitate insertion of holster 100 into pocket 22 of pants 20.

Figure 10:
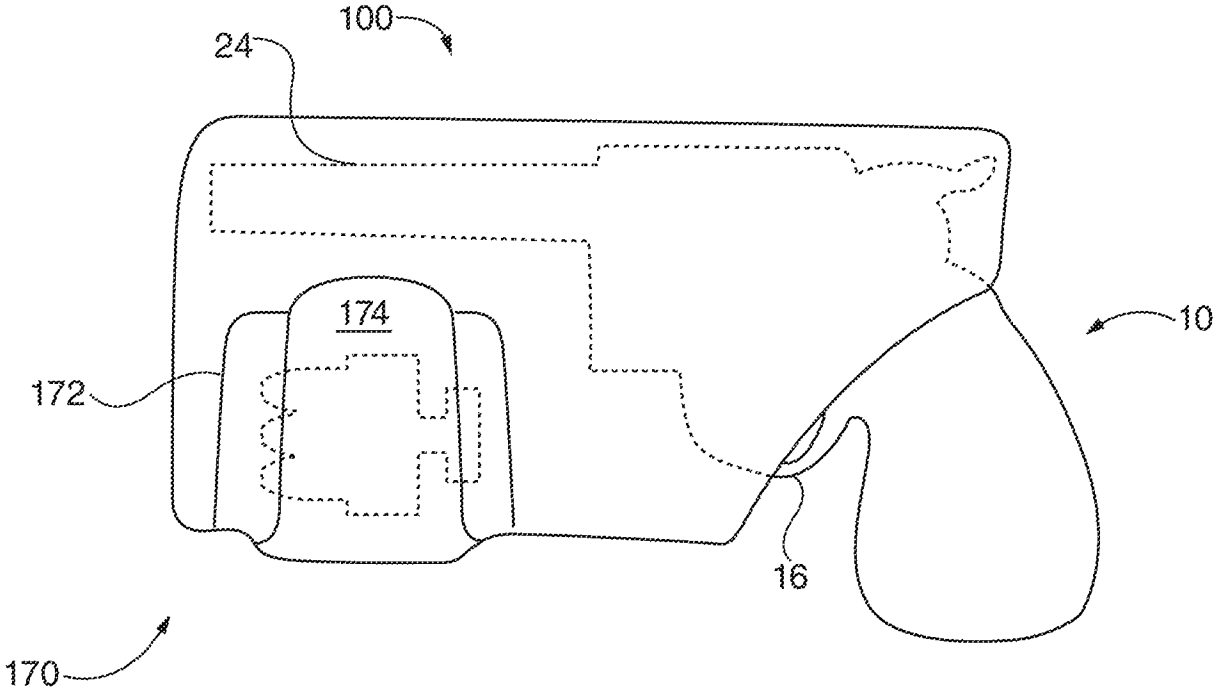
FIG. 10 is a diagrammatic side view of a gun and a speed loader both received within a holster, according to yet another aspect of the invention.

Turning now to FIG. 10, holster 100 may further comprise a speed loader holder 170 located in front of trigger guard 16 and below a barrel 24 of gun 10. Speed loader holder 170 may comprise a chamber 172 as part of sheath 106, with a closure flap 174, for example. Closure flap 174 may utilize hook and loop material (not shown) as a fastener. The recited location of speed loader holder 170 is advantageous as it orients a speed loader 26 appropriately fox intuitive installation into gun 10 (which in this example is of course a revolver), and also utilizes space of holster 100 efficiently. That is, in this location, chamber 172 does not add objectionably to the overall profile of holster 100.

It has been stated that holster 100 may be fabricated from a pliable or flexible material. Therefore, again referring to FIG. 1, the invention may he regarded as a holster (e.g., holster 100) comprising sheath 106 including mouth 108 for insertion of gun 10 and opposed distal end 110, wherein sheath 106 comprises a flexible structural substrate further comprising a neoprene fabric coated with polyparaphenylene terephthalamide. In this aspect of the invention, the flexible structural substrate may further comprise retentive surface 114 covering at least part of the flexible structural substrate, and retentive surface 114 of sheath **106*i* may comprise hook and loop manual fastener for enabling holster 100** to be retained to an environmental surface.

Where holster 100 comprises the pliable or flexible material, it is desirable to impart frictional characteristics which tend to hold gun 10 within sheath 106, and hold holster 100 in place regardless of how holster 100 is worn. Also, hook and loop material, particularly hook material to be more particularly defined hereinafter, is suitable for wicking liquids, such as sweat, so as to dissipate such liquids. External patches of hook and loop material have been found to be effective in achieving these ends.

One example of a suitable hook material which may be utilized with holster 100 as described herein is available as "Duragrip" brand, a nylon 8 mil, monofilament product having two hundred eighty hooks per square inch.

One example of a suitable loop material is available from Velcro Industries N.V., Wilemstad, Curacao, via a U.S. subsidiary. The material is a wide loop, low profile warp knit fully nylon material, 3001 series as designated by the manufacturer, with a loop profile designated by the manufacturer as 89.

One example of a suitable flexible structural substrate comprising neoprene fabric coated with polyparaphenylene terephthalamide is available from Trelleborg Indusgtri AB, Trelleborg, Sweden, designated by the manufacturer as HANK series, thirty-five ounce.

Hook and loop materials listed above may be bonded to the coated neoprene fabric using a spray adhesive available from 3M Company, St. Paul, Minn., designated by the manufacturer as Hi-Strength 90.

The present invention is susceptible to modifications and variations which may be introduced thereto without departing from the inventive concepts. For example, in some implementations, the structural substrate may not be flexible or readily deformed by hand, and may comprise a plastic or polymeric material.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A holster providing at least one detachable functional enhancement module, to selectively vary accommodation of different guns, different holster wearing conditions, and different holster mountings, the holster comprising:

a sheath including a mouth for insertion of a gun and an opposed distal end, the sheath comprising a structural substrate and a retentive surface covering at least part of the structural substrate; and at least one detachable functional enhancement module including a respective retention surface removably attachable by contact with the retentive surface of the sheath, wherein the at least one functional enhancement module comprises at least one of a first functional enhancement module comprising a stop inside the sheath when installed, the stop locatable and configured to limit penetration of the gun into the sheath, a second functional enhancement module comprising a tensioning tab inside the sheath when installed, the tensioning tab locatable and configured to constrict the sheath to a width less than that which the sheath would assume in the absence of the constriction tab, to snug the sheath against the gun, a third functional enhancement module comprising a belt clip including a retention surface removably attachable by contact with the retentive surface of the sheath, a fourth functional enhancement module comprising a pressure pad removably locatable at the mouth of the sheath and configured to receive a thumb or finger of the user and to transmit a pushing force from the thumb or finger against the sheath, thereby facilitating withdrawal of the gun from the sheath when the user grasps the gun and presses on the pressure pad with the thumb or finger, a fifth functional enhancement module comprising a mouth spreader tab inside the sheath when installed, the mouth spreader tab locatable and configured to oppose spontaneous narrowing of the sheath after the gun is withdrawn therefrom, to facilitate subsequent reinsertion of the gun past the mouth and into the sheath, and;

a sixth functional enhancement module comprising a docking station including a mounting side bearing an adhesive and an opposed holster retaining side comprising a retention surface removably attachable by contact with the retentive surface of the sheath of the holster.

2. The holster of claim 1, wherein the belt clip comprises, a feature configured to oppose tendency of fabric of pants worn by a user of the holster to separate the belt clip from the gun as the gun is being withdrawn from the holster when the holster is contained within a pocket of the pants, the belt clip comprising a first hook for engaging a belt installed on the Pants and a second hook encircling an exposed edge of the pants, wherein the first hook and the second hook open in opposed directions.

3. The holster of claim 1, wherein the mouth spreader tab of the fifth functional enhancement module comprises a first ply including hook and loop Material and a stiffener structure configured to increase stiffness of the first ply.

4. The holster of claim 3, wherein the stiffener structure comprises a plastic panel parallel to and abutting the first ply.

5. The holster of claim 1, wherein the docking station has a length at least half of the length of the sheath, and a height at least half of the height of the sheath.

6. The holster of claim 1, wherein the docking station includes: a belt engagement element enabling the docking Station to be supported from the belt of the wearer.

7. The holster of claim 1, wherein:

the structural substrate of the sheath comprises a flexible neoprene fabric coated with polyparaphenylene terephthalamide;

the retentive surface of the sheath comprises hook and loop manual fastener of one polarity; and:

each said functional enhancement module comprises a respective contact patch for engaging the retentive surface of the sheath, each said respective contact patch comprising hook and loop manual fastener of a polarity other than that of the retentive surface of the sheath.

8. The holster of claim 7, wherein:

the structural substrate of the sheath includes an inner surface facing the gun when the gun is inside the holster, and an opposed outer surface visible to view; and the retentive surface of the sheath covers at least most of the inner surface of the structural substrate.

9. The holster of claim 8, wherein the retentive surface of the sheath extends to at least part of the outer surface of the sheath.

10. The holster of claim 9, wherein the retentive surface of the sheath comprises hook or loop fastening material covering an exposed edge of the mouth of the sheath, to oppose snagging of the gun when the gun is reinserted into the holster.

11. The holster of claim 9 wherein an extended portion of the retentive surface of the Sheath may cover a forward edge of the holster, thereby opposing snagging of the holster on a pocket when the holster is being inserted into the pocket.

12. The holster of claim 1, further comprising a speed loader holder located in front of the trigger guard and below the barrel of the gun.

13. The holster of claim 1, wherein the flexible structural substrate further comprises a neoprene fabric Coated with polyparaphenylene terephthalamide.

14. The holster of claim 13, wherein the flexible structural substrate further comprises a retentive surface covering at least part of the flexible structural substrate, and the retentive surface of the sheath comprises hook and loop manual fastener for enabling the holster to be retained to an environmental surface.

* * * * *